US011718443B2

(12) United States Patent
Haddad

(10) Patent No.: US 11,718,443 B2
(45) Date of Patent: Aug. 8, 2023

(54) CONTAINERS FOR TRANSPORTING ITEMS AND METHODS OF ARRANGING SUCH CONTAINERS

(71) Applicant: Issam Anton Haddad, Hammond, IN (US)

(72) Inventor: Issam Anton Haddad, Hammond, IN (US)

( * ) Notice: Subject to any disclaimer, the term of this patent is extended or adjusted under 35 U.S.C. 154(b) by 323 days.

(21) Appl. No.: 17/218,836

(22) Filed: Mar. 31, 2021

(65) Prior Publication Data

US 2021/0309410 A1 Oct. 7, 2021

Related U.S. Application Data

(60) Provisional application No. 63/003,935, filed on Apr. 2, 2020.

(51) Int. Cl.
*B65D 5/20* (2006.01)
*B65D 5/46* (2006.01)
*B65D 81/38* (2006.01)

(52) U.S. Cl.
CPC ..... *B65D 5/2057* (2013.01); *B65D 5/46104* (2013.01); *B65D 81/386* (2013.01)

(58) Field of Classification Search
CPC B65D 5/2057; B65D 5/46104; B65D 81/386; B65D 5/46128; B65D 5/46136; B65D 5/46112; B65D 5/46144; B65D 5/46096; B65D 5/6635; B65D 5/6664
USPC .... 229/103.11, 117.15, 117.14, 186, 117.13, 229/122.24, 103.3, 155, 157; 206/549
See application file for complete search history.

(56) References Cited

U.S. PATENT DOCUMENTS

| | | | | |
|---|---|---|---|---|
| 5,853,121 | A * | 12/1998 | Francisco | B65D 5/2047 229/117.14 |
| 6,581,823 | B1 * | 6/2003 | De Beck | B65D 5/6664 229/117.14 |
| 7,314,158 | B2 * | 1/2008 | McKenna, Sr. | B65D 5/46096 229/143 |
| 9,126,706 | B2 * | 9/2015 | Rodriguez | B65B 11/48 |
| 10,974,865 | B2 * | 4/2021 | Cardoze | B65B 5/024 |
| D936,476 | S * | 11/2021 | Sollie | D9/432 |
| 2004/0031842 | A1 * | 2/2004 | Westerman | B65D 81/38 229/117.06 |
| 2007/0251982 | A1 * | 11/2007 | Brand | B65D 5/321 229/101 |
| 2021/0292042 | A1 * | 9/2021 | Sollie | B65D 5/241 |

* cited by examiner

*Primary Examiner* — Christopher R Demeree
(74) *Attorney, Agent, or Firm* — Hartman Global IP Law; Gary M. Hartman; Domenica N.S. Hartman

(57) ABSTRACT

Containers for storing and transporting items such as but not limited to traditional disposable aluminum pans, and methods of arranging such containers. A first container includes a base panel, four side panels coupled to the base panel, two cover panels pivotally coupled to two of the side panels, and two top panels pivotally coupled to the other two side panels. A second container includes a base panel, four side panels coupled to the base panel, two cover panels pivotally coupled to two of the side panels, a top panel pivotally coupled to another of the side panels, a front panel pivotally coupled to the top panel, and a separation panel pivotally coupled to the last of the side panels. The containers are configured to be arranged in assembled configurations that define enclosed compartments suitable for storing items.

17 Claims, 10 Drawing Sheets

CONTAINERS FOR TRANSPORTING ITEMS AND METHODS OF ARRANGING SUCH CONTAINERS

CROSS REFERENCE TO RELATED APPLICATIONS

This application claims the benefit of U.S. Provisional Application No. 63/003,935, filed Apr. 2, 2020, the contents of which are incorporated herein by reference.

BACKGROUND OF THE INVENTION

The present invention generally relates to containers. The invention particularly relates to containers suitable for transporting items, including but not limited to food containers.

Recently, restaurants that traditionally did not provide a food delivery option have begun contracting with third party food delivery services. This has led to a rapid increase in food delivery throughout the restaurant industry. Some food orders now being delivered are provided in containers that may not be easily carried by a delivery employee or a recipient. For example, many restaurants use disposable aluminum pans for storing foods. While economic and convenient for restaurants, these pans generally require support across a significant portion of the bottom thereof to reduce the risk of spilling the foods they contain, and therefore generally require an individual to use both hands when carrying the pans to ensure that the pan bottoms are adequately supported. In addition, these relatively thin, metallic pans may conduct heat from any warm contents they may contain, which may cause burns or discomfort if individuals directly contact the pans.

With the recent expansion of food delivery options, it can be appreciated that there is a desire for systems and methods suitable for promoting ease of carrying traditional food containers, including but not limited to aluminum pans.

BRIEF DESCRIPTION OF THE INVENTION

The present invention provides containers suitable for storing and transporting other containers, including but not limited to food containers, and methods of arranging such containers.

According to one aspect of the invention, a container is provided that includes a base panel, first, second, third, and fourth side panels, first and second cover panels, and first and second top panels. The base panel has first, second, third, and fourth edges. The first, second, third, and fourth side panels each have oppositely disposed first and second edges with the first edges thereof coupled to the first, second, third, and fourth edges of the base panel, respectively. The first and second side panels are oppositely disposed one another and the third and fourth side panels are oppositely disposed one another. The first and second cover panels each have oppositely disposed first and second edges and are each pivotally coupled along the first edge thereof to the second edge of the third and fourth side panels, respectively. Each of the first and second cover panels include first and second handle portions, respectively, pivotally coupled along the second edge of the first and second cover panels. The first and second top panels have oppositely disposed first and second edges and are each pivotally coupled along the first edge thereof to the second edges of the first and second side panels, respectively. The second top panel has one or more fastener tabs coupled along the second edge thereof that are configured to be received in one or more respective fastener slots of the first top panel. The base panel, the first, second, third, and fourth side panels, the first and second cover panels, and the first and second top panels are configured to be arranged in an assembled configuration wherein the first, second, third, and fourth side panels are oriented perpendicular to the base panel, the first and second cover panels are oriented parallel with the base panel, the first and second handle portions are oriented perpendicular to the first and second cover panels and extend away from the base panel, the first and second top panels are parallel with the base panel, overlay the first and second cover panels, and receive portions of the first and second handle portions within and through handle slots of the first and second top panels, and the fastener tab(s) are releasably secured within the fastener slot(s) and thereby releasably secure the first and second top panels over the first and second cover panels. When arranged in the assembled configuration, a compartment is defined by a cavity between interior surfaces of the base panel, the first, second, third, and fourth side panels, the first and second cover panels, and portions of the first and second top panels.

According to another aspect of the invention, a container is provided that includes a base panel, first, second, third, and fourth side panels, first and second cover panels, a top panel, a front panel, and a separation panel. The base panel has first, second, third, and fourth edges. The first, second, third, and fourth side panels each have oppositely disposed first and second edges with the first edges thereof coupled to the first, second, third, and fourth edges of the base panel, respectively. The first and second side panels are oppositely disposed one another and the third and fourth side panels are oppositely disposed one another. The second side panel has a dimension from the first edge thereof to the second edge thereof that is smaller than dimensions of the first, third, and fourth side panels from the respective first edges thereof to the corresponding second edges thereof. The second side panel has at least one fastener slot. The first and second cover panels each have oppositely disposed first and second edges and are each pivotally coupled along the first edge thereof to the second edge of the third and fourth side panels, respectively. Each of the first and second cover panels include first and second handle portions, respectively, pivotally coupled along the second edge of the first and second cover panels. The top panel has oppositely disposed first and second edges and is pivotally coupled along the first edge thereof to the second edge of the first side panel. The top panel has a handle slot thereon. The front panel has oppositely disposed first and second edges and is pivotally coupled along the first edge thereof to the second edge of the top panel. The front panel has at least one fastener tab coupled along the second edge of the front panel that is configured to be received in the at least one fastener slot of the second side panel. The separation panel has oppositely disposed first and second edges and is pivotally coupled along the first edge thereof to the second edge of the second side panel. The base panel, the first, second, third, and fourth side panels, the first and second cover panels, the top panel, the front panel, and the separation panel are configured to be arranged in an assembled configuration wherein the first, second, third, and fourth side panels are oriented perpendicular to the base panel, the first and second cover panels are oriented parallel with the base panel, the first and second handle portions are oriented perpendicular to the first and second cover panels and extend away from the base panel, the top panel is parallel with the base panel, overlays the first and second cover panels, and receives the first and second handle portions within and through the handle slot of the first and second top panels, the front panel is perpendicular to the top panel, the fastener tab is releasably secured within the fastener slot and thereby releasably secures the front panel and the second side panel, and the separation panel is perpendicular to the second side panel. When arranged in the assembled configuration, a first compartment is defined by a first cavity between interior surfaces of the base panel, the first, second, third, and fourth side panels, and the separation panel and a second compartment is defined by a second cavity between interior surfaces of the separation panel, the first, third, and fourth side panels, the front panel, the first and second cover panels, and portions of the top panel.

According to yet another aspect of the invention, a method is provided of arranging a container as described above into the assembled configuration. The method includes providing a sheet of material comprising the base panel, the first, second, third, and fourth side panels, the first and second cover panels, the top panel, the front panel, and the separation panel, folding the sheet along the first, second, third, and fourth edges of the base panel such that the first, second, third, and fourth side panels, the first and second cover panels, the top panel, the front panel, and the separation panel are perpendicular to the base panel, folding the sheet along the second edge of the second side panel such that the separation panel is perpendicular to the second side panel and parallel to the base panel, folding the sheet along second edges of the first and second cover panels such that the first and second handle portions are perpendicular to the first and second cover panels, respectively, folding the sheet along the second edges of the third and fourth side panels such that the first and second cover panels are perpendicular to the third and fourth side panels, respectively, and parallel to the base panel wherein the first and second handle portions are perpendicular to and extend away from the base panel, folding the sheet along the second edge of the first side panel such that the top panel is perpendicular to the first side panel, parallel to the base panel, overlays the first and second cover panels, and receives the first and second handle portions within and through the handle slot thereof, folding the sheet along the second edge of the front panel such that the fastener tab is perpendicular to the front panel, folding the sheet along the second edge of the top panel such that the front panel is perpendicular to the top panel, and inserting the fastener tab of the top panel into the fastener slot of the second side panel and thereby releasably secure the front panel and the second side panel.

Technical effects of the containers and methods described above preferably include the ability to easily transport one or more items within compartment(s) thereof, such as conventional food containers that require substantial support to avoid spillage.

Other aspects and advantages of this invention will be appreciated from the following detailed description.

DETAILED DESCRIPTION OF THE INVENTION

Figure 1:
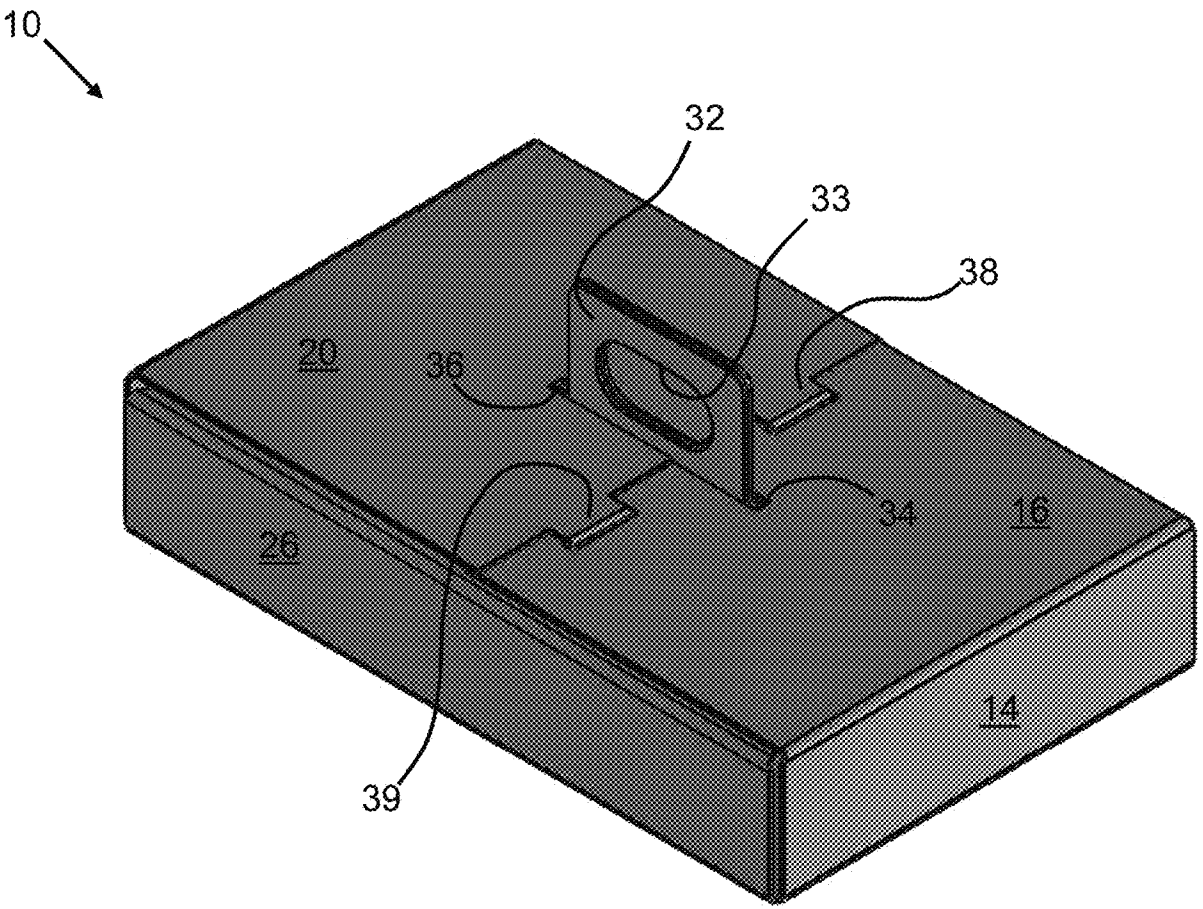
FIGS. 1 through 4 represent perspective, top, side, and end views, respectively, of a first embodiment of a container in accordance with certain nonlimiting embodiments of the invention.
Figure 2:
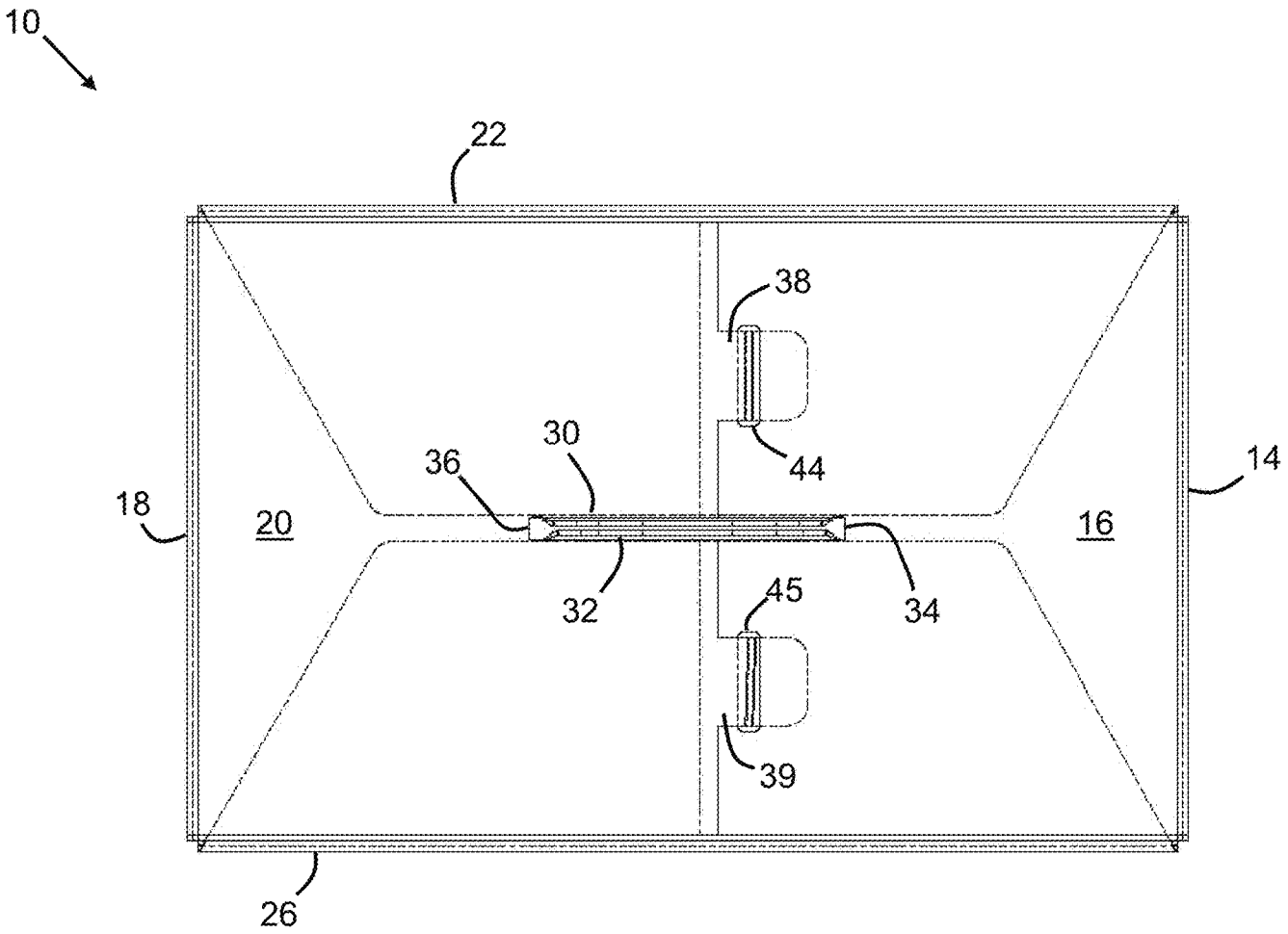

Certain conventional food containers, including but not limited to disposable aluminum pans, require substantial support along a bottom thereof to avoid spillage. Containers disclosed herein provide convenient storage for such food containers and have features that promote their transportation. These containers provide that capability to carry multiple food containers simultaneously, while providing support to an entirety of bottoms of the food containers.

The intended purpose of the following detailed description of the invention and the phraseology and terminology employed therein is to describe what is shown in the drawings, which include the depiction of nonlimiting embodiments of the invention, and to describe certain but not all aspects of the embodiments depicted in the drawings. The following detailed description also identifies certain but not all alternatives of the depicted embodiments. Therefore, the appended claims, and not the detailed description, describe what is believed to be one or more aspects of the invention.

FIGS. 1 through 4 represent a first embodiment of a container 10 configured for storing and transporting food containers such as but not limited to traditional disposable aluminum pans. In this embodiment, the container 10 includes a single compartment configured to store one or more food containers, including but not limited to a single, rectangular pan.

The container 10 of FIGS. 1 through 4 includes a base panel 12, four side panels 14, 18, 22, and 26, two cover panels 24 and 28, and two top panels 16 and 20. Each of the side panels 14, 18, 22, and 26 have edges pivotally coupled to respective edges of the base panel 12. The cover panels 24 and 28 have edges pivotally coupled to respective edges of the side panels 22 and 26, respectively, and the top panels 16 and 20 have edges pivotally coupled to respective edges of the side panels 14 and 18, respectively.

The base panel 12, the side panels 14, 18, 22, and 26, the cover panels 24 and 28, and the top panels 16 and 20 are configured to be arranged in an assembled configuration as represented in FIGS. 1 through 4. In this configuration, the side panels 14, 18, 22, and 26 are perpendicular to the base panel 12, the cover panels 24 and 28 are parallel with the base panel 12, and the top panels 16 and 20 are parallel with the base panel 12 and overlay the cover panels 24 and 28.

When arranged in this assembled configuration, a compartment is defined by a cavity between interior surfaces of the base panel 12, side panels 14, 18, 22, and 26, cover panels 24 and 28, and certain portions of the top panels 16 and 20. The base panel 12 provides a surface on which a food container may be located such that an entirety of a bottom of the food container is supported by the base panel 12 during storage and transport.

The cover panels 24 and 28 include handle portions 30 and 32, respectively, pivotally coupled along the edges of the cover panels 24 and 28. The handle portions 30 and 32 include handle openings 31 and 33, respectively. When arranged in the assembled configuration, the handle portions 30 and 32 are oriented perpendicular to the cover panels 24 and 28, extend away from the base panel 12, and, optionally, may contact one another. In combination, the handle portions 30 and 32 define a handle with an opening that provides access for an individual to grip to carry the container 10 during transport.

The top panel 20 includes a pair of fastener tabs 38 and 39 that are configured to be received within and releasably retained by fastener slots 44 and 45, respectively, of the top panel 16. When the fastener tabs 38 and 39 are mated with the fastener slots 44 and 45, the top panels 16 and 20 are secured relative to one another and therefore the side panels 14 and 18 and top panels 16 and 20 are maintained in fixed positions relative to one another. Although not shown, one or both of the cover panels 16 and 20, or the fastener tabs 38 and 39 may be further releasably secured with one or more fasteners (not shown), including but not limited to adhesive tapes, hoop and loop fasteners, belt and buckles, etc.

The top panels 16 and 20 include handle slots 34 and 36, respectively, configured to receive the handle portions 30 and 32 of the cover panels 24 and 28. When in the assembled configuration, the side panels 22 and 26 and the cover panels 24 and 28 are maintained in fixed positions relative to one another due to contact between the handle portions 30 and 32 and edges of the top panels 16 and 20 around perimeters of the handle slots 34 and 36. In this manner, the edges of the top panels 16 and 20 around perimeters of the handle slots 34 and 36 act as barriers to prevent outward unfolding of the side panels 22 and 26 and the cover panels 24 and 28.

During transport of the container 10, the side panels 22 and 26 and the cover panels 24 and 28 may be held in place by the top panels 16 and 20 which overlay the cover panels 24 and 28. Specifically, when an individual lifts and carries the container 10 by grasping the handle portions 30 and 32, the cover panels 24 and 28 experience an upward force (away from the base panel 12) from the handle portions 30 and 32 due to the weight of the container 10 and any contents stored therein. This upward force causes the cover panels 24 and 28 to contact the top panels 16 and 20 and/or distal ends of the fastener tabs 38 and 39 (discussed in more detail below). Since the top panels 16 and 20 are secured with the fastener tabs 38 and 39, the top panels 16 and 20 act as barriers to retain the side panels 22 and 26 and the cover panels 24 and 28 in their respective positions.

In addition, this upward force may further promote a secure coupling between the fastener tabs 38 and 39 and the fastener slots 44 and 45. Specifically, the upward force may cause the cover panels 24 and 28 to contact the distal ends of the fastener tabs 38 and 39 which are in turn pinched between the cover panels 24 and 28 and the top panel 16. As such, the weight of the container 10 and any contents stored therein may promote a secure connection between the top panels 16 and 20.

Figure 3:
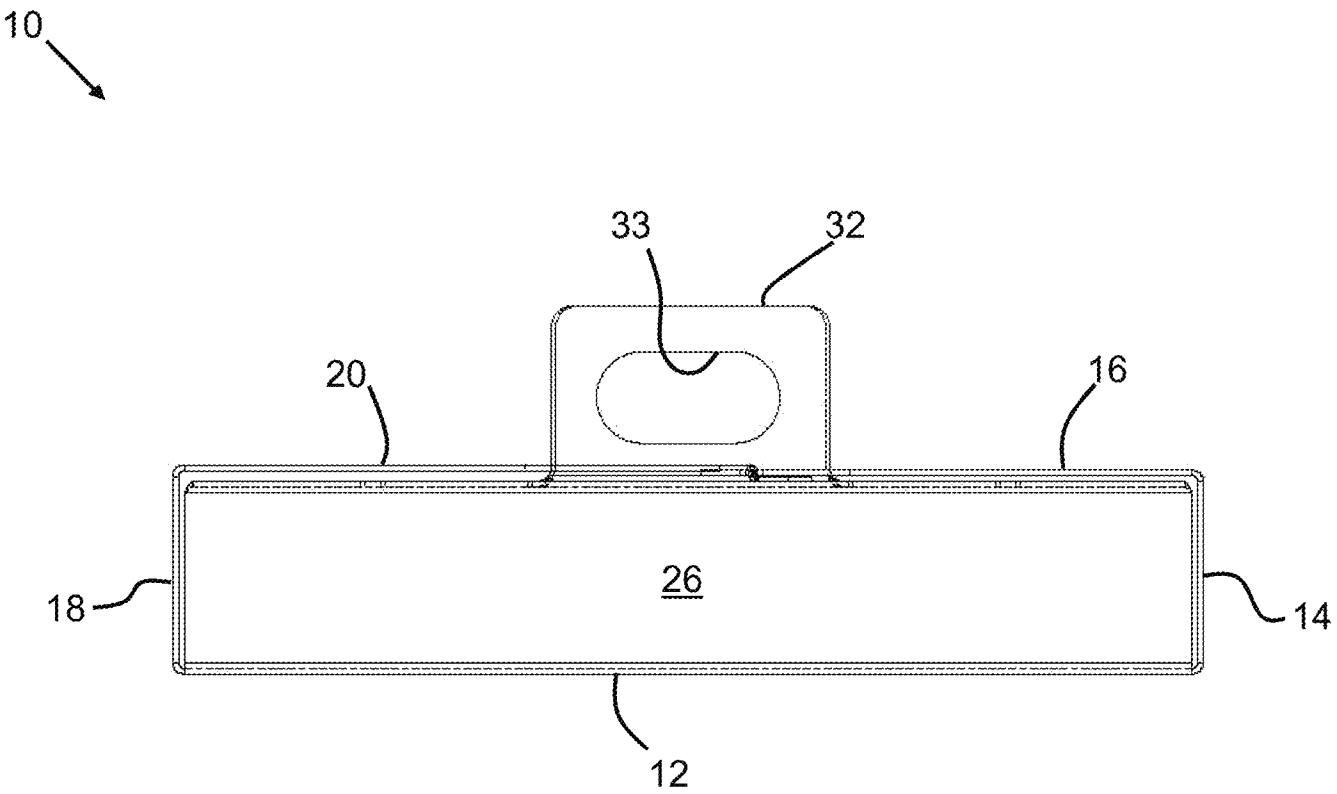
Figure 4:
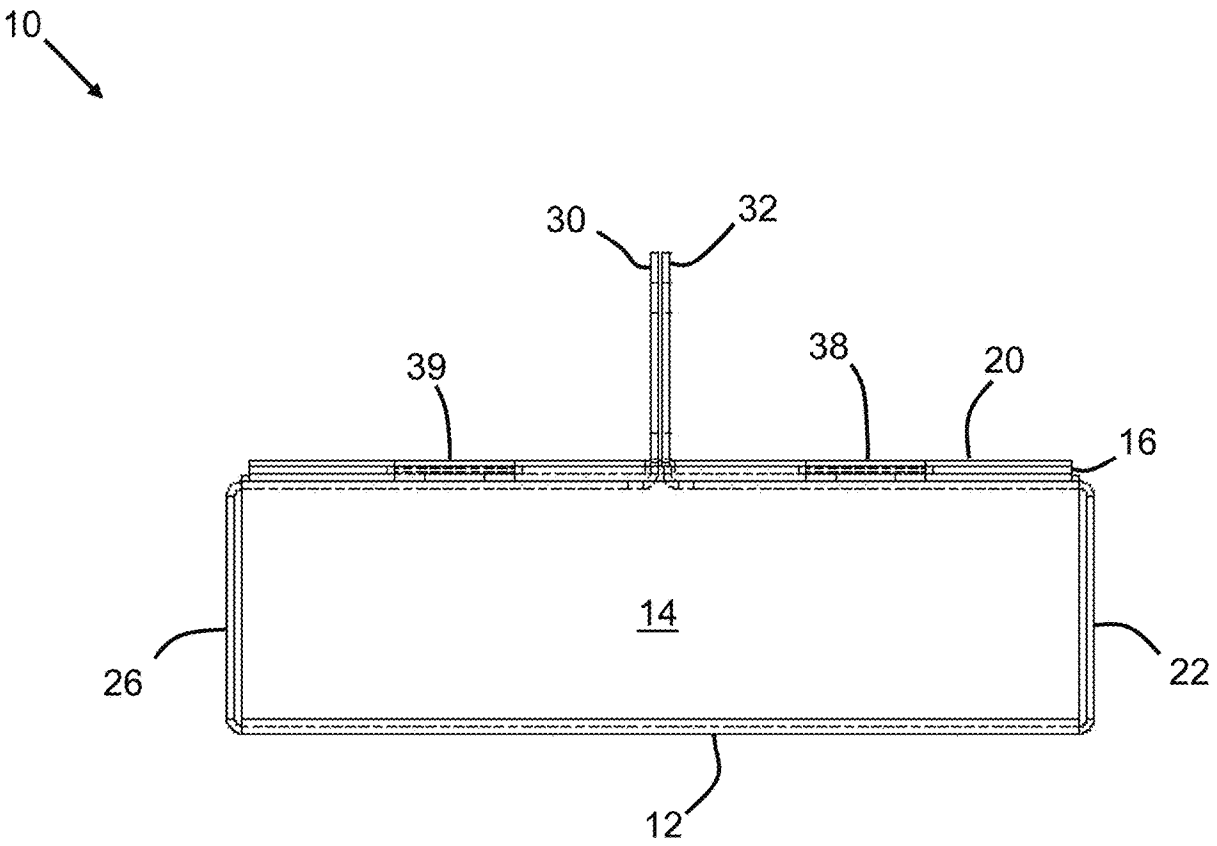
Figure 5:
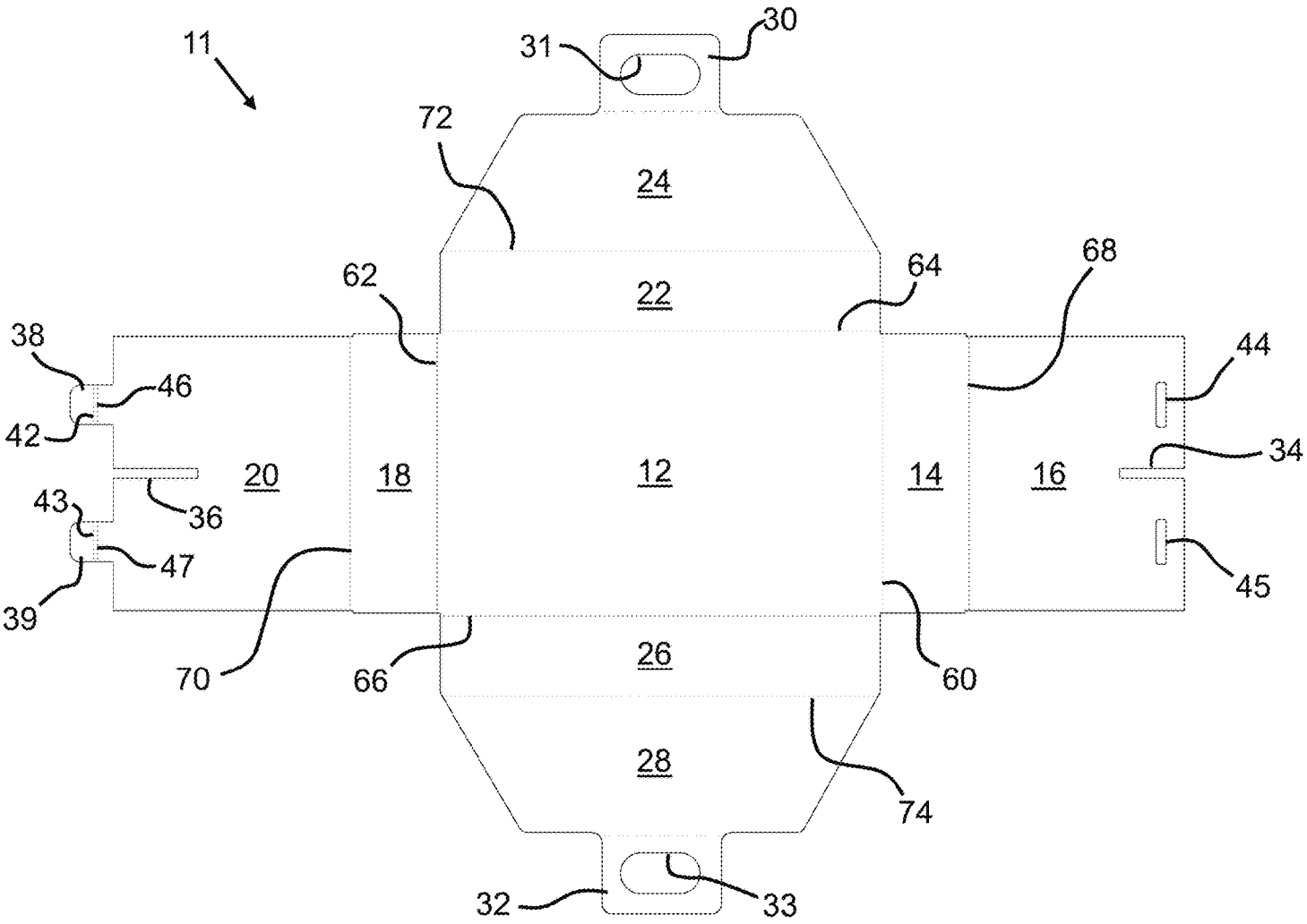
FIG. 5 represents a planar sheet configured to be folded to form the container of FIGS. 1 through 4.
Figure 6:
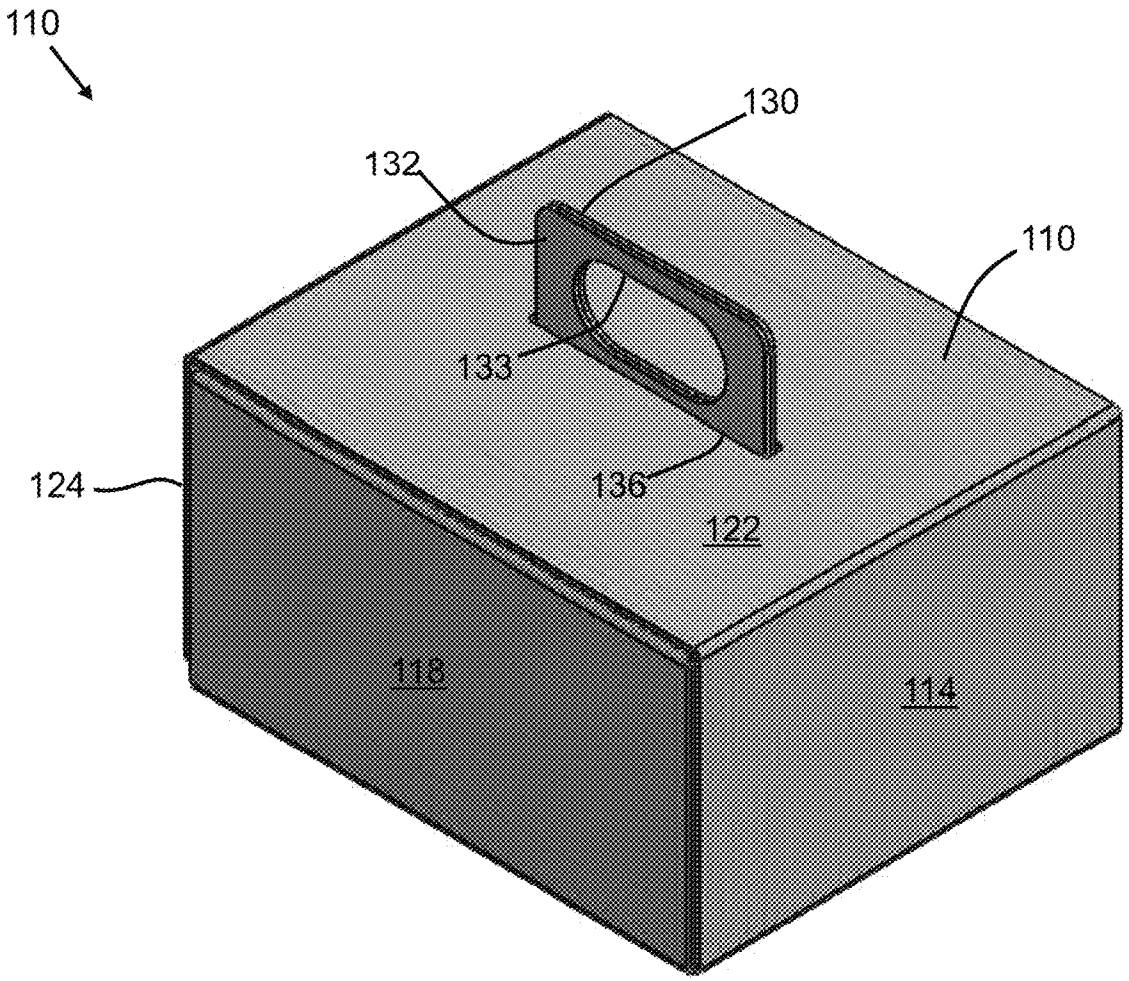
FIGS. 6 through 9 represent perspective, top, side, and end views, respectively, of a second embodiment of a container in accordance with certain nonlimiting embodiments of the invention.
Figure 7:
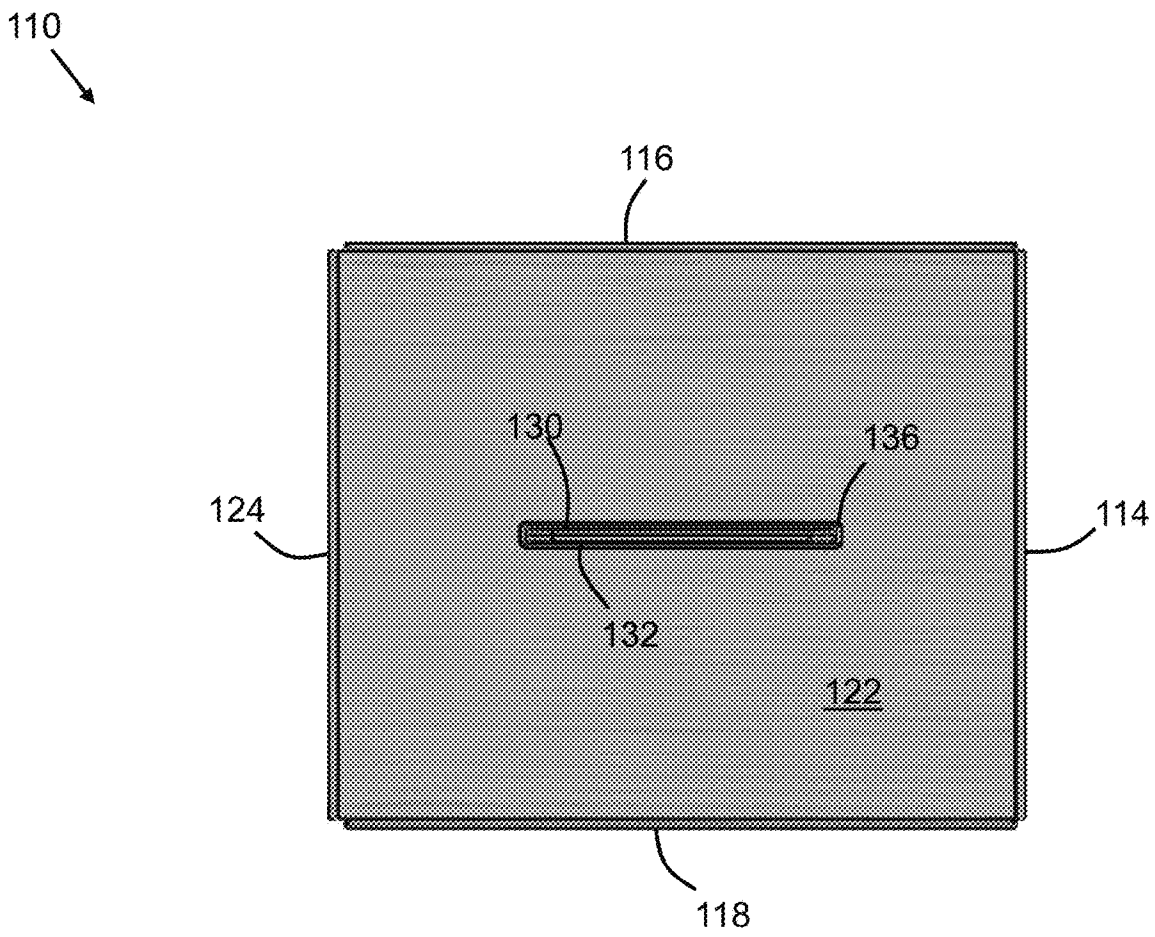

FIG. 5 represents a single, integrated sheet 11 of planar material having multiple individual panels that may be folded along score lines to produce the container 10 of FIGS. 1 through 4. Although the container 10 is formed of a single sheet 11 of material in this embodiment, it is foreseeable and within the scope of the invention that the container 10 may be formed by multiple coupled sheets of a single or multiple materials.

To form the container 10 from the sheet 11 represented in FIG. 5, the sheet 11 may be folded into the assembled configuration as described below. Notably, some of the folding steps described below may be performed in other orders without changing the end result.

The sheet 11 may be folded about 90 degrees along score lines 60, 62, 64, and 66 such that the side panels 14, 18, 22, and 26, the cover panels 24 and 28, and the top panels 16 and 20 are substantially perpendicular to the base panel 12, and folded about 90 degrees along score lines 48 and 49 such that the handle portions 30 and 32 are substantially perpendicular to the cover panels 24 and 28. The sheet 11 may then be folded about 90 degrees along score lines 72 and 74 such that the cover panels 24 and 28 are substantially perpendicular to the side panels 14, 18, 22, and 26 and substantially parallel to the base panel 12, and the handle portions 30 and 32 protrude away from the base panel 12.

Once the previous folds have been completed, the sheet 11 may be folded about 90 degrees along a score line 68 such that the top panel 16 is substantially perpendicular to the side panel 14 and substantially parallel to the base panel 12. This fold causes the handle portions 30 and 32 to be partially received within the handle slot 34, and the top panel 16 to overlay portions of the cover panels 24 and 28. The sheet 11 may then be folded about 90 degrees along a score line 70 such that the top panel 20 is substantially perpendicular to the side panel 18 and substantially parallel to the base panel 12. This fold causes the handle portions 30 and 32 to be partially received within the handle slot 36, and the top panel 20 to overlay portions of the cover panels 24 and 28.

Finally, the fastener tabs 38 and 39 may be inserted into the fastener slots 44 and 45, respectively. In the embodiment represented in FIGS. 1 through 5, ease of the insertion of the fastener tabs 38 and 39 may be promoted by first folding the sheet 11 about 90 degrees along score lines 46 and 47 and about 90 degrees along score lines 42 and 43. These folds result in the fastener tabs 38 and 39 each having a proximal portion extending from and aligned with the top panel 20, and an intermediate portion perpendicular to the proximal portion and the top panel 20, and a distal portion perpendicular to the intermediate portion and parallel to the proximal portion and the top panel 20.

After folding along the score lines 42, 43, 46, and 47, distal ends of the fastener tabs 38 and 39 may be inserted into the fastener slots 44 and 45 such that the distal end of the fastener tab 38 is located between the top panel 16 and the cover panel 24 and the distal end of the fastener tab 39 is located between the top panel 16 and the cover panel 28, as represented in FIGS. 3 and 4. In this assembled configuration, the top panels 16 and 20 are releasably secured to one another.

It should be noted that once folding has been completed and the container 10 is in the assembled configuration, the container 10 does not include an opening that provides access to the compartment within the container 10. In such embodiments, food containers intended to be stored in the compartment should be located on the base panel 12 prior to folding the sheet 11 or may be inserted into the compartment after beginning the folding process but prior to folding along score lines 68 and/or 70 and securing the top panels 16 and 20 to one another. Any food containers stored within the compartment will be inaccessible without at least partially unfolding the container 10. Alternatively, it is foreseeable and within the scope of the invention that one or more of the side panels 14, 18, 22, and 24 may include an opening (not shown) with or without a cover that provides access to the compartment after the folding process is completed and the container 10 is in the assembled configuration.

FIGS. 6 through 9 represent a second embodiment of a container 110 configured for storing and transporting food containers such as but not limited to traditional disposable aluminum pans. In this embodiment, the container 110 includes two separate compartments configured to store multiple food containers, such as two rectangular pans.

The container 110 of FIGS. 6 through 9 includes a base panel 112, three side panels 114, 116, and 118, two cover panels 136 and 138, a top panel 122, a front panel 124, a partial side panel 128, and a separation panel 134. Each of the side panels 114, 116, and 118, and the partial side panel 128 have edges pivotally coupled to respective edges of the base panel 112. The cover panels 136 and 138 have edges pivotally coupled to respective edges of the side panels 116 and 118, respectively, the top panel 122 has an edge pivotally coupled to a respective edge of the side panel 114, the front panel 124 has an edge pivotally coupled to a respective edge of the top panel 122, and the separation panel has an edge pivotally coupled to a respective edge of the partial side panel 128.

The base panel 112, the side panels 114, 116, and 118, the cover panels 136 and 138, the top panel 122, the front panel 124, the partial side panel 128, and the separation panel 134 are configured to be arranged in an assembled configuration as represented in FIGS. 6 through 9. In this configuration, the side panels 114, 116, and 118, and the partial side panel 128 are perpendicular to the base panel 112, the cover panels 136 and 138 are parallel with the base panel 112, the top panel 122 is parallel with the base panel 112 and overlays the cover panels 136 and 138.

When arranged in this assembled configuration, a first compartment within the container 110 is defined by a cavity between interior surfaces of the base panel 112, the side panels 114, 116, and 118, the partial side panel 128, and the separation panel 134, and a second compartment is defined by a cavity between interior surfaces of the separation panel 134, the side panels 114, 116, and 118, the cover panels 136 and 138, portions of the top panel 122, and the front panel 124. The base panel 112 and the separation panel 134 provide surfaces on which food containers may be located such that an entirety of the bottoms of the food containers are supported by either the base panel 112 or the separation panel 134 during storage and transport.

The cover panels 136 and 138 include handle portions 130 and 132, respectively, pivotally coupled along the edges of the cover panels 136 and 138. The handle portions 130 and 132 include handle openings 131 and 133, respectively. When arranged in the assembled configuration, the handle portions 130 and 132 are perpendicular to the cover panels 136 and 138, extend away from the base panel 112, and, optionally, may contact one another. In combination, the handle portions 130 and 132 define a handle with an opening that provides access for an individual to grip to carry the container 110 during transport.

The front panel 124 includes a fastener tab 126 that is configured to be received within and releasably retained by a fastener slot 144 of the partial side panel 128. When the fastener tab 126 is mated with the fastener slot 144, the front panel 124 and the partial side panel 128 are secured relative to one another and therefore the side panel 114, top panel 122, front panel 124, partial side panel 128, and the separation panel 134 are maintained in fixed positions relative to one another. Although not shown, the front panel 124 or the fastener tab 126 may be further releasably secured with one or more fasteners (not shown), including but not limited to adhesive tapes, hoop and loop fasteners, belt and buckles, etc.

The top panel 122 includes a handle slot 135 configured to receive the handle portions 130 and 132 of the cover panels 136 and 138. The side panels 116 and 118 and the cover panels 136 and 138 are maintained in fixed positions relative to one another due to contact between the handle portions 130 and 132 and edges of the top panel 122 around a perimeter of the handle slot 135. In this manner, the edges of the top panel 122 around the perimeter of the handle slot 135 acts as barrier to prevent outward unfolding of the side panels 116 and 118 and the cover panels 136 and 138.

During transport of the container 110, the side panels 116 and 118 and the cover panels 136 and 138 may be held in place by the top panel 122 which overlays the cover panels 136 and 138. Specifically, when an individual lifts and carries the container 110 by grasping the handle portions 130 and 132, the cover panels 136 and 138 experience an upward force (away from the base panel 112) from the handle portions 130 and 132 due to the weight of the container 110 and any contents stored therein. This upward force causes the cover panels 136 and 138 to contact the top panel 122. Since the top panel 122 is secured relative to the front panel 124 due to the coupling of the fastener tab 126 and the fastener slot 144, the top panel 122 acts as a barrier to retain the side panels 116 and 118 and the cover panels 136 and 138 in their respective positions.

Figure 10:
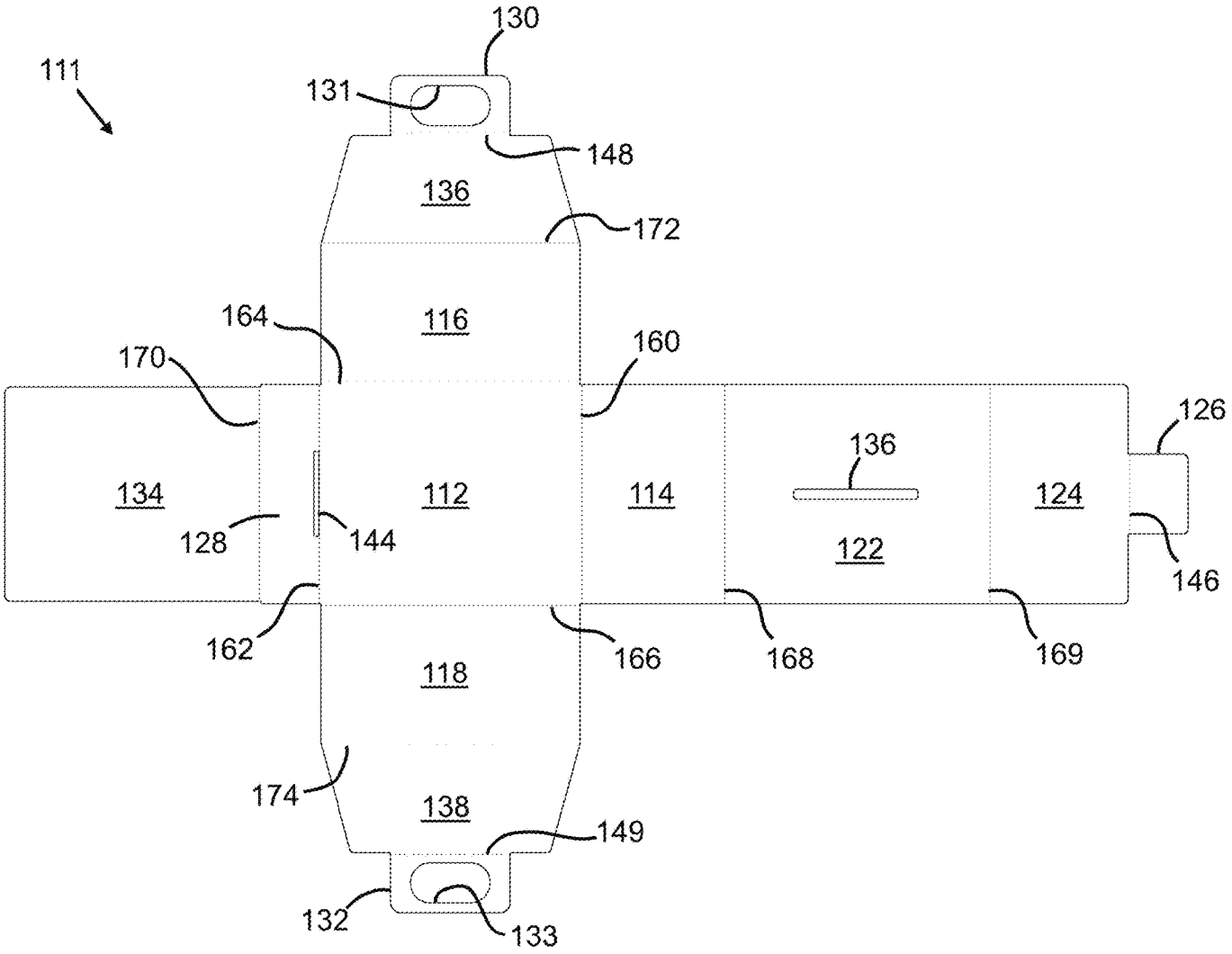
FIG. 10 represents a planar sheet configured to be folded to form the container of FIGS. 6 through 9.

FIG. 10 represents a single, integrated sheet 111 of planar material having multiple individual panels that may be folded along score lines to produce the container 110 of FIGS. 6 through 9. Although the container 110 is formed of a single sheet 111 of material in this embodiment, it is foreseeable and within the scope of the invention that the container 110 may be formed by multiple coupled sheets of a single or multiple materials.

To form the container 110 from the sheet 111 represented in FIG. 10, the sheet 111 may be folded into the assembled configuration as described below. Notably, some of the folding steps described below may be performed in other orders without changing the end result.

The sheet 111 may be folded about 90 degrees along score lines 160, 162, 164, and 166 such that the side panels 114, 116, and 118, the cover panels 136 and 138, the top panel 122, the front panel 124, the partial side panel 128, and the separation panel 134 are substantially perpendicular to the base panel 112, and folded about 90 degrees along score lines 148 and 149 such that the handle portions 130 and 132 are substantially perpendicular to the cover panels 136 and 138. The sheet 111 may then be folded about 90 degrees along a score line 170 such that the separation panel 134 is substantially perpendicular to the partial side panel 128 and substantially parallel to and suspended above the base panel 112. The sheet 111 may then be folded about 90 degrees along score lines 172 and 174 such that the cover panels 136 and 138 are substantially perpendicular to the side panels 116 and 118 and substantially parallel to the base panel 112.

Once the previous folds have been completed, the sheet 111 may be folded about 90 degrees along a score line 168 such that the top panel 122 is substantially perpendicular to the side panel 114 and substantially parallel to the base panel 112. This fold causes the handle portions 130 and 132 to be received within the handle slot 135, and the top panel 122 to overlay of the cover panels 136 and 138.

Figure 8:
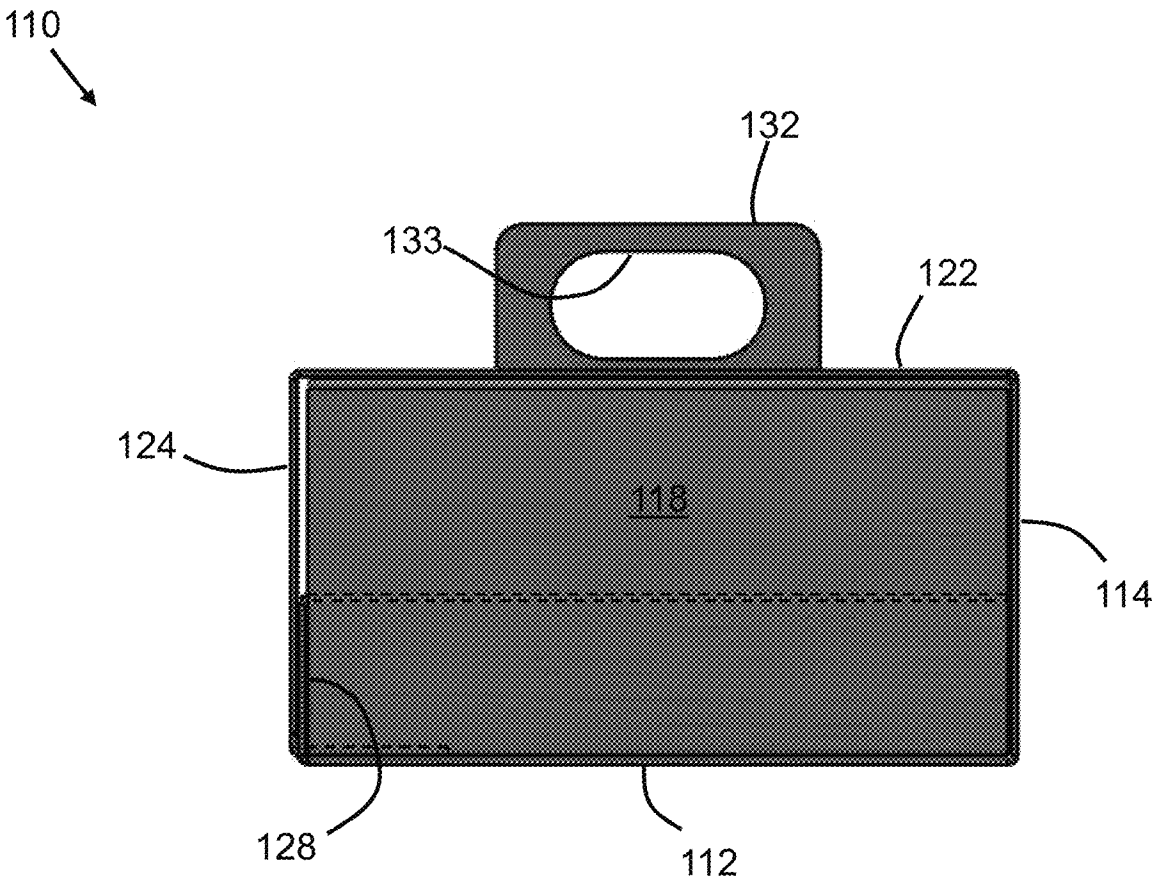
Figure 9:
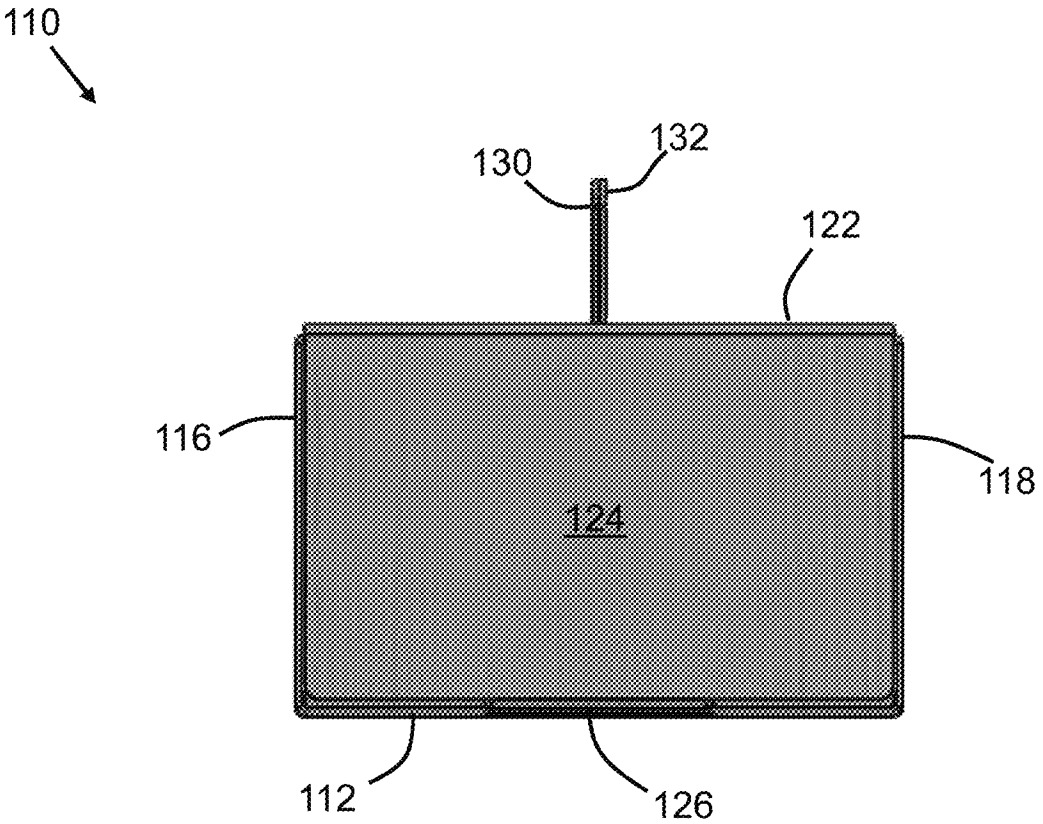

Finally, the sheet 111 may be folded about 90 degrees along a score line 146 such that the fastener tab 126 is substantially perpendicular to the separation panel 134, and folded about 90 degrees along a score line 169 such that the front panel 124 is substantially perpendicular to the top panel 122 and substantially parallel to the partial side panel 128. After folding along the score lines 146 and 169, the fastener tab 126 may be inserted into the fastener slot 144 such that the fastener tab 126 is located within the first compartment between the base panel 112 and the separation panel 134, as represented in FIG. 8. In this arrangement, the front panel 124 and the partial side panel 128 are releasably secured to one another.

It should be noted that once folding has been completed and the container 110 is in the assembled configuration, the container 110 does not include an opening that provides access to the compartments within the container 110. In such embodiments, food containers intended to be stored in the first compartment should be located on the base panel 112 prior to folding the sheet 111 or may be inserted into the compartment after beginning the folding process but prior to folding along the score line 170 to orient the separation panel 134 over the base panel 112. Food containers intended to be stored in the second compartment should be located on the separation panel 134 after folding along the score line 170 but prior to enclosing the second compartment by folding along the score line 169 and coupling the fastener tab 126 and the fastener slot 144. Any food containers stored within the compartments will be inaccessible without at least partially unfolding the container 110. Alternatively, it is foreseeable and within the scope of the invention that one or more of the side panels 114, 116, and 118, the partial side panel 128, and/or the separation panel 134 may include an opening (not shown) with or without a cover that provides access to the first and/or second compartment after the folding process is completed and the container 110 is in the assembled configuration.

In certain embodiments, the container 110 may be intended to store and transport food containers that do not have sufficient structural support for stacking, such as food containers without lids or food containers covered with aluminum foil. In such embodiments, the container 110 include additional structural features that enable the separation panel 134 to support the weight of any food containers located thereon without applying downward forces on any food containers stored therebelow in the first compartment. The separation panel 134 may be fixed to the side panels 114, 116, and/or 118, may rest on protuberances extending into the first compartment from the side panels 114, 116, and/or 118, may include legs configured to contact the base panel 112, or may include any other structural features configured to prevent or reduce the likelihood of damaging food containers located below the separation panel 134.

In certain embodiments, the container 110 may include additional separation panels configured to be located within the first and/or second compartment and thereby divide the first and/or second compartments into still additional compartments. For example, the container 110 may include an additional extension panel coupled to at a first edge thereof to the separation panel 134 and coupled at a second edge thereof to an additional separation panel that is substantially identical to the separation panel 134. In such an exemplary embodiment, the sheet 111 may be folded along a score line to orient the extension panel perpendicular to the separation panel 134 and parallel to the side panel 114, and folded along another score line to orient the additional separation panel perpendicular to the extension panel and parallel to the separation panel 134. This type of modification may be repeated to add multiple separation panels and thereby define additional compartments. In other embodiments, the separation panel 134 may be omitted or removed to combine the first and second compartments and provide a single, larger compartment.

The containers 10 and 110 may be formed of various materials and may be reusable and/or disposable. As a nonlimiting example, the containers 10 and 110 may be formed of corrugated cardboard. Optionally, exterior surfaces of the containers 10 and 110 may include markings including logos, advertisements, warnings, instructions, etc. The containers 10 and 110 may include other features related to the transport of food items such as but not limited to insulation.

To promote ease of folding and to provide flush contact between folded panels, one or more of the panels of the containers 10 and 110 may have reduced dimensions relative to adjacent panels. As examples, the top panels 16 and 20 of the container 10 have reduced dimensions along the score lines 68 and 70 relative to the side panels 14 and 18, and the separation panel 134 of the container 110 has a reduced dimension along the score line 170 relative to the partial side panel 128. In addition, one or more of the panels of the containers 10 and 110 may include chamfered corners. As examples, the cover panels 24 and 28 of the container 10 and the cover panels 136 and 138 of the container 110 include chamfered corners along outer edges thereof.

Although the containers 10 and 110 have been described herein as suitable for storing and transporting food containers, it should be understood that the containers 10 and 110 may be used to store and transport various other items.

While the invention has been described in terms of specific embodiments, it is apparent that other forms could be adopted by one skilled in the art. For example, the physical configuration of the containers 10 and 110 could differ from that shown, and materials and processes/methods other than those noted could be used. In addition, the invention encompasses additional or alternative embodiments in which one or more features or aspects of a particular embodiment could be eliminated or two or more features or aspects of different disclosed embodiments could be combined. Accordingly, it should be understood that the invention is not necessarily limited to any embodiment described herein or illustrated in the drawings. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A container comprising:

a base panel having first, second, third, and fourth edges;

first, second, third, and fourth side panels each having oppositely disposed first and second edges, the first, second, third, and fourth side panels coupled along the first edge thereof to the first, second, third, and fourth edges of the base panel, respectively, the first and second side panels being oppositely disposed one another and the third and fourth side panels being oppositely disposed one another;

first and second cover panels each having oppositely disposed first and second edges, the first and second cover panels each pivotally coupled along the first edge thereof to the second edge of the third and fourth side panels, respectively, each of the first and second cover panels including first and second handle portions, respectively, pivotally coupled along the second edge of the first and second cover panels; and first and second top panels having oppositely disposed first and second edges, the first and second top panels each pivotally coupled along the first edge thereof to the second edges of the first and second side panels, respectively, the second top panel having one or more fastener tab(s) coupled along the second edge of the second top panel that are configured to be received in one or more respective fastener slot(s) of the first top panel;

wherein the base panel, the first, second, third, and fourth side panels, the first and second cover panels, and the first and second top panels are configured to be arranged in an assembled configuration wherein the first, second, third, and fourth side panels are oriented perpendicular to the base panel, the first and second cover panels are oriented parallel with the base panel, the first and second handle portions are oriented perpendicular to the first and second cover panels and extend away from the base panel, the first and second top panels are parallel with the base panel, overlay the first and second cover panels, and receive portions of the first and second handle portions within and through handle slots of the first and second top panels, and the fastener tab(s) are releasably secured within the fastener slot(s) and thereby releasably secure the first and second top panels over the first and second cover panels, a compartment being defined by a cavity between interior surfaces of the base panel, the first, second, third, and fourth side panels, the first and second cover panels, and portions of the first and second top panels when arranged in the assembled configuration.

2. The container of claim 1, wherein the first, second, third, and fourth side panels are pivotally coupled along the first edge thereof to the first, second, third, and fourth edges of the base panel, respectively.

3. The container of claim 1, wherein the base panel, the first, second, third, and fourth side panels, the first and second cover panels, and the first and second top panels are formed from a single integrated sheet of material.

4. The container of claim 1, wherein the first and second handle portions of the first and second cover panels are configured to contact one another and define a handle when arranged in the assembled configuration, the handle having a handle opening that provides access for an individual to grip the handle.

5. The container of claim 1, wherein the first and second cover panels are configured to contact the first and second top panels and be restrained thereby when an force is applied to the handle portions in a direction away from the base panel while arranged in the assembled configuration.

6. The container of claim 1, wherein the fastener tab(s) of the second top panel are configured to be inserted into the fastener slot(s) of the first top panel such that distal end(s) of the fastener tab(s) are located between the first top panel and the first and/or second cover panels.

7. The container of claim 6, wherein the fastener tab(s) of the second top panel are configured to be folded such that the distal end(s) of the fastener tab(s) can be inserted between the first top panel and the first and/or second cover panels.

8. The container of claim 6, wherein the first and second cover panels are configured to contact the distal end(s) of the fastener tab(s) of the second top panel when an force is applied to the handle portions in a direction away from the base panel and pinch the distal end(s) of the fastener tab(s) against the first top panel while arranged in the assembled configuration.

9. The container of claim 1, wherein the first and second top panels have dimensions along the first edges thereof that are smaller than dimensions of the first and second side panels along the second edges thereof.

10. A container comprising:

a base panel having first, second, third, and fourth edges;

first, second, third, and fourth side panels each having oppositely disposed first and second edges, the first, second, third, and fourth side panels coupled along the first edge thereof to the first, second, third, and fourth edges of the base panel, respectively, the first and second side panels being oppositely disposed one another and the third and fourth side panels being oppositely disposed one another, the second side panel having a dimension from the first edge thereof to the second edge thereof that is smaller than dimensions of the first, third, and fourth side panels from the respective first edges thereof to the corresponding second edges thereof, the second side panel having at least one fastener slot;

first and second cover panels each having oppositely disposed first and second edges, the first and second cover panels each pivotally coupled along the first edge thereof to the second edge of the third and fourth side panels, respectively, each of the first and second cover panels including first and second handle portions, respectively, pivotally coupled along the second edge of the first and second cover panels;

a top panel having oppositely disposed first and second edges, the top panel pivotally coupled along the first edge thereof to the second edge of the first side panel, the top panel having a handle slot thereon;

a front panel having oppositely disposed first and second edges, the front panel pivotally coupled along the first edge thereof to the second edge of the top panel, the front panel having at least one fastener tab coupled along the second edge of the front panel that is configured to be received in the at least one fastener slot of the second side panel; and a separation panel having oppositely disposed first and second edges, the separation panel pivotally coupled along the first edge thereof to the second edge of the second side panel;

wherein the base panel, the first, second, third, and fourth side panels, the first and second cover panels, the top panel, the front panel, and the separation panel are configured to be arranged in an assembled configuration wherein the first, second, third, and fourth side panels are oriented perpendicular to the base panel, the first and second cover panels are oriented parallel with the base panel, the first and second handle portions are oriented perpendicular to the first and second cover panels and extend away from the base panel, the top panel is parallel with the base panel, overlays the first and second cover panels, and receives the first and second handle portions within and through the handle slot of the first and second top panels, the front panel is perpendicular to the top panel, the fastener tab is releasably secured within the fastener slot and thereby releasably secures the front panel and the second side panel, and the separation panel is perpendicular to the second side panel, a first compartment being defined by a first cavity between interior surfaces of the base panel, the first, second, third, and fourth side panels, and the separation panel when arranged in the assembled configuration, a second compartment being defined by a second cavity between interior surfaces of the separation panel, the first, third, and fourth side panels, the front panel, the first and second cover panels, and portions of the top panel when arranged in the assembled configuration.

11. The container of claim 10, wherein the first, second, third, and fourth side panels are pivotally coupled along the first edge thereof to the first, second, third, and fourth edges of the base panel, respectively.

12. The container of claim 10, wherein the base panel, the first, second, third, and fourth side panels, the first and second cover panels, the top panel, the front panel, and the separation panel are formed from a single integrated sheet of material.

13. The container of claim 10, wherein the first and second handle portions of the first and second cover panels are configured to contact one another and define a handle when arranged in the assembled configuration, the handle having a handle opening that provides access for an individual to grip the handle.

14. The container of claim 10, wherein the first and second cover panels are configured to contact the top panel and be restrained thereby when an force is applied to the handle portions in a direction away from the base panel while arranged in the assembled configuration.

15. The container of claim 10, wherein the separation panel is configured to support a weight applied thereon from within the second compartment without applying downward forces on any items stored in the first compartment.

16. The container of claim 10, further comprising an additional separation panel configured to be located within either the first compartment or the second compartment and oriented parallel to the base panel.

17. The container of claim 10, wherein the separation panel has a dimension along the first edge thereof that is smaller than a dimension of the second side panel along the second edge thereof.

* * * * *